US006964263B2

(12) United States Patent
Xi et al.

(10) Patent No.: US 6,964,263 B2
(45) Date of Patent: Nov. 15, 2005

(54) ELECTRICALLY OPERATED FUEL INJECTION APPARATUS

(75) Inventors: Daguang Xi, Tianjin (CN); Songling Cao, Jiangsu (CN)

(73) Assignee: Zhejiang Fai Electronics Co. Ltd., Zhejiang (CN)

( * ) Notice: Subject to any disclaimer, the term of this patent is extended or adjusted under 35 U.S.C. 154(b) by 90 days.

(21) Appl. No.: 10/468,099

(22) PCT Filed: Feb. 10, 2002

(86) PCT No.: PCT/CN02/00086

§ 371 (c)(1),
(2), (4) Date: Aug. 15, 2003

(87) PCT Pub. No.: WO02/066817

PCT Pub. Date: Aug. 29, 2002

(65) Prior Publication Data

US 2004/0065304 A1 Apr. 8, 2004

(30) Foreign Application Priority Data

Feb. 16, 2001 (CN) ..... 01103954 A

(51) Int. Cl.[7] ..... F02M 37/04
(52) U.S. Cl. ..... 123/499; 417/417
(58) Field of Search ..... 123/497, 499, 123/458; 239/585.1–585.5, 88–95; 417/417, 417/440, 569

(56) References Cited

U.S. PATENT DOCUMENTS

| | | | | |
|---|---|---|---|---|
| 3,282,219 A | | 12/1964 | Blackwell et al. | |
| 4,526,145 A | | 7/1985 | Honma et al. | |
| 4,623,860 A | | 11/1986 | Baker et al. | |
| 4,972,996 A | | 11/1990 | Cerny | |
| 5,469,828 A | * | 11/1995 | Heimberg et al. | 123/497 |
| 5,518,372 A | | 5/1996 | Chin | |
| 5,779,454 A | * | 7/1998 | Binversie et al. | 417/417 |
| 6,036,120 A | * | 3/2000 | Varble et al. | 239/585.1 |
| 6,401,696 B1 | * | 6/2002 | Heimberg | 123/499 |
| 6,422,836 B1 | | 7/2002 | Krueger et al. | |

FOREIGN PATENT DOCUMENTS

| | | |
|---|---|---|
| EP | 0 756 080 A2 | 1/1997 |
| JP | A-59-49365 | 3/1984 |
| WO | WO 91/11846 | 8/1991 |
| WO | WO 96/34196 | 10/1996 |
| WO | WO 00/19086 | 4/2000 |
| WO | WO 01/55584 A2 | 8/2001 |

* cited by examiner

*Primary Examiner*—Weilun Lo

(74) *Attorney, Agent, or Firm*—Berenato, White & Stavish

(57) ABSTRACT

This invention relates to an electrically operated fuel injection apparatus comprising a fuel inletting device (110), a fuel pumping device (112) and a fuel injecting device (113). Fuel from the said fuel inletting device (110) is pumped by the said fuel pumping device (112) and then is injected out by the said fuel injecting device, wherein the said fuel pumping device (112) includes an operating coil (13), a returning coil (12) and a driven device (114) driven by the magnetic fields of these two coils; the magnetic loop induced by the said operating coil (13) excites the said driven device 9114) so as to inject the fuel by the said fuel injecting device (113), and the magnetic loop induced by the said returning coil (12) excites the said driven device to return back to its original position.

18 Claims, 4 Drawing Sheets

ELECTRICALLY OPERATED FUEL INJECTION APPARATUS

TECHNICAL FIELD

The present invention relates to electrically operated fuel injection apparatus, especially fuel injection apparatus driven by electromagnetic coils.

BACKGROUND ART

Two types of electrically operated fuel injection apparatus have been known. In one of the two types, the electronic system is just for controlling the opening and closing of the fuel injector, and the injection pressure is totally supplied by another system, which could be a mechanical system or an electrical fuel pump. The other type is a system in which a plunger pump is driven periodically by electromagnetic force, controlled by an electronic system, to generate an injection pressure so as to realize pulse injection. As examples of the first type, one may cite the electronic fuel injection (EFI) system adopted in four-stroke gasoline engine and the electrically controlled high-pressure common trail fuel injection system used in high-speed diesel engine (cf. Chapter VI, *Internal Combustion Engine,* compiled by Zhou Baolong, published by the Press of Engineering Industry in 1998, Beijing). As an example of the second type, one may cite the fuel injection system, developed by the Ficht Inc. of Germany, which is operating with the principle of solid energy storage (cf. U.S. Pat. No. 5,469,828 published in 1995 and CN patent application No. 9,619,481,5.9 published in 1998). The main drawbacks of the first type include its complexity and high cost. Consequently, it is difficult to apply on engines where the cost is limited, such as for motorcycle. The second type is simple in construction and low in cost, however, conventionally, single electromagnetic coil is used to drive the follower in forward direction, and the return of the follower relies on spring force. Consequently, a part of the forward electromagnetic driving force has to overcome the resistance of the spring, and the motion characteristics of the follower depends greatly on the stiffness and pretightening force of the spring. Therefore, the maximum operating frequency of the fuel injection system is limited and injection pressure is relatively low. Thus, it is difficult to use such injection system on high-speed engine such as the engine of motorcycles etc.

SUMMARY OF THE INVENTION

The object of the invention is to provide electrically operated fuel injection apparatus with higher operating frequency and sufficiently high injection pressure to meet the requirements of high-speed engine.

Above object is achieved by an electrically operated fuel injection apparatus comprising: a fuel intake means, a fuel pumping means and a fuel injecting means, wherein the fuel introduced via the fuel intake means is pressed by the fuel pumping means and is injected out from the fuel injecting means. The fuel pumping means includes a working coil, a return coil and a follower driven by the two coils. The follower is driven by the magnetic loop formed by the working coil to press the fuel to be injected out from the fuel injecting means, and is returned backward by the magnetic loop formed by the return coil. The electromagnetic fields of the coils are generated from so-called PWM voltage-current wave, that is, pulse width modulated voltage-current wave, input via respective wire connections.

Preferably, the working coil and the return coil are arranged coaxially, and the directions of currents are controlled so that the magnetic fields passing through the follower are kept steadily consistent with each other or alternating with each other.

Preferably, the follower comprises an armature and a plunger, which may be integral with each other, or may be two separated components, which may be made of different materials. The plunger is substantially cylindrical in shape with a central fuel channel running through it, and with a shoulder on the leading end for limiting the initial position of the plunger. Between the separated plunger and armature there is a valve for closing the fuel channel and controlled by the armature. The body of the valve may be a ball and mounted on the leading end of the armature, for example, embedded in the armature. A spacer may be disposed between the ball valve and the armature, and a valve seat having, for example, conical surface, may be disposed on the rear end of the plunger. The shape of the armature is substantially cylindrical with axial through-hole or through groove. A boss is provided on the armature's front-end face in which the ball valve is embedded. In the central portion of the armature is a cutout of material, that is, a circumferential groove. The movement of the armature is limited in an armature chamber. The front-end face of the armature is constantly located near or within the magnetic gap of the forward driving magnetic loop. The rear end face of the armature is constantly located near or within the magnetic gap of the return driving magnetic loop. The elements constituting the wall of the armature chamber including electromagnetic elements made of, such as, pure iron, low carbon steel and etc., sliding fitted with the armature, and non-magnetizing or poor-electromagnetic elements made of, such as, copper, stainless steel and etc., sliding fitted or clearance fitted with the armature.

The inventive fuel injection equipment may be further modified by an elastic element for energy storage, which is disposed in the rear-most portion of the armature chamber, and whose deformation is very small. The elastic element may be, for example, a curved sheet metal, or a spiral wire spring.

The fuel intake means of the inventive fuel injection equipment include a circumferential groove provided on the cavity body, a one-way valve, a fuel inlet disposed on the housing, and a fuel returning mechanism. The outlet of the one-way valve is communicated with a pressure chamber and the inlet thereof is communicated with the circumferential groove. Furthermore, a channel communicating the armature chamber with the circumferential groove may be provided on the cavity body for facilitating massive fuel returning. Between the armature chamber and the fuel returning outlet, a rear end element with a through-hole may be disposed, which is kept communicating with the armature chamber via the through hole or grooves on the armature. The rear end element may also be made of hard magnetic or permanent magnetic material. For replacing the low-pressure fuel supply means, in the fuel returning circuit or the rear end element, a one-way valve for fuel returning may also be provided for forcibly generating a sufficiently large amount of returned fuel by making use of the return action of the follower.

The fuel injecting means of the inventive fuel injection equipment comprises a fuel delivery valve, a high-pressure fuel passage and an atomizer nozzle. The fuel delivery valve comprises a valve body, a valve seat and spring. The valve body may be spherical and the valve seat may be an axisymmetric curved surface; or, the valve body may be a planar sheet and the valve seat may be an O-ring. The high-pressure fuel passage may be a hole, for mounting the atomizer nozzle, in the cavity body, or may be an inner bore of a high-pressure fuel pipe communicating the fuel delivery valve with the atomizer nozzle. The atomizer nozzle may comprise a nozzle body, a needle stem and spring, wherein the cone portion in the front end portion of the needle stem constitutes a valve body, the conical surface of the nozzle body constitute a valve seat, and the nozzle body is provided with fuel inlet(s) and passage(s). The valve cap and the valve stem are integrated into one, and the axial gap between nozzle body and the valve cap constitutes the maximum lift of the needle valve.

According to above technical solution, the forward and return movements of the follower are controlled respectively by electropulse signals input from outside for electromagnetic operation. During a period within the forward movement or the return movement, the follower encounters almost zero resistance. Consequently, the acceleration and the velocity of the follower during the forward injection period and/or return period may be very high. In very short time, for example 2 milliseconds, the follower may obtain adequate kinetic energy for impacting the fuel in the pressure chamber. Thus, the fuel injection pressure may be improved and very high operating frequency, of, for example, 150 Hz, may be obtained.

The following technical features are also in favor of the reliability of the equipment when operating in high frequency. The coaxial arrangement of the working coil and the return coil results in a compact structure of the equipment. The through-hole or through-groove provided in axial direction on the armature reduces flow resistance, derived from the fuel flowing relatively to the armature, to such an extent that the resistance could be ignored. The sliding fit or clearance fit between the armature and the armature chamber ensures the movement of the armature is not influenced by solid friction. The circumferential groove in the central portion of the armature is to adjust the moving mass of the follower. The elastic element for energy storage may prevent the armature from being adsorbed on the rear end face of the armature chamber.

Depending on the structure of fuel injection equipment and operating environment in its typical application, the bubbles in the fuel is an important factor affecting the operating reliability and the calibrated injection amount per cycle. The space occupied by fuel comprises the pressure chamber, the armature chamber, the high-pressure passage and etc. The bubbles generated in the pressure chamber and the high-pressure passage affect the operation of the system the most seriously. The high-pressure passage refers to the space for fuel flowing between the pressure chamber and the injection nozzle. The armature chamber is the space necessary for the reciprocal movement of the armature. The bubbles mainly derive from: residual air; vaporization of part of fuel in the high pressure passage and/or pressure chamber by the heat transmitted from outside such as the combustion chamber; vaporization of part of fuel in the armature chamber by friction heat and/or electrical resistance heat generated by the coil; and fuel vaporization or libertion of dissolved gas from the fuel, caused by local negative pressure generated from fuel movement in the armature chamber and/or pressure chamber. In the present invention, because of various solutions for reducing bubbles, the reliability and stability are ensured even when the apparatus operates in high frequency By dividing the follower into two portions, that is, the armature and the plunger, and by providing a channel in the plunger and valve(s) for closing the channel, the passages for returning fuel and discharging bubbles become shorter, which facilitate the discharge of bubbles in the pressure chamber. The fuel returning system is designed with sufficiently high flux, so that the injecting means could be cooled lest bubbles should be generated due to heat, and bubbles generated could be discharged out.

In the inventive fuel injection equipment, a fuel delivery valve is disposed in the fuel injecting means, so that a predetermined initial pressure could be maintained in the high pressure passage so as to prevent bubbles in it, thus the fuel injection quantity per pulse is stabilized. The atomizer nozzle may be mounted on the body of the fuel injection equipment, or may be communicated with the body via a high-pressure fuel pipe so that the injection nozzle could be mounted into the engine easier.

DETAILED DESCRIPTION OF THE INVENTION

Now the present invention will be described in details with reference to the accompanying drawings.

Figure 1:
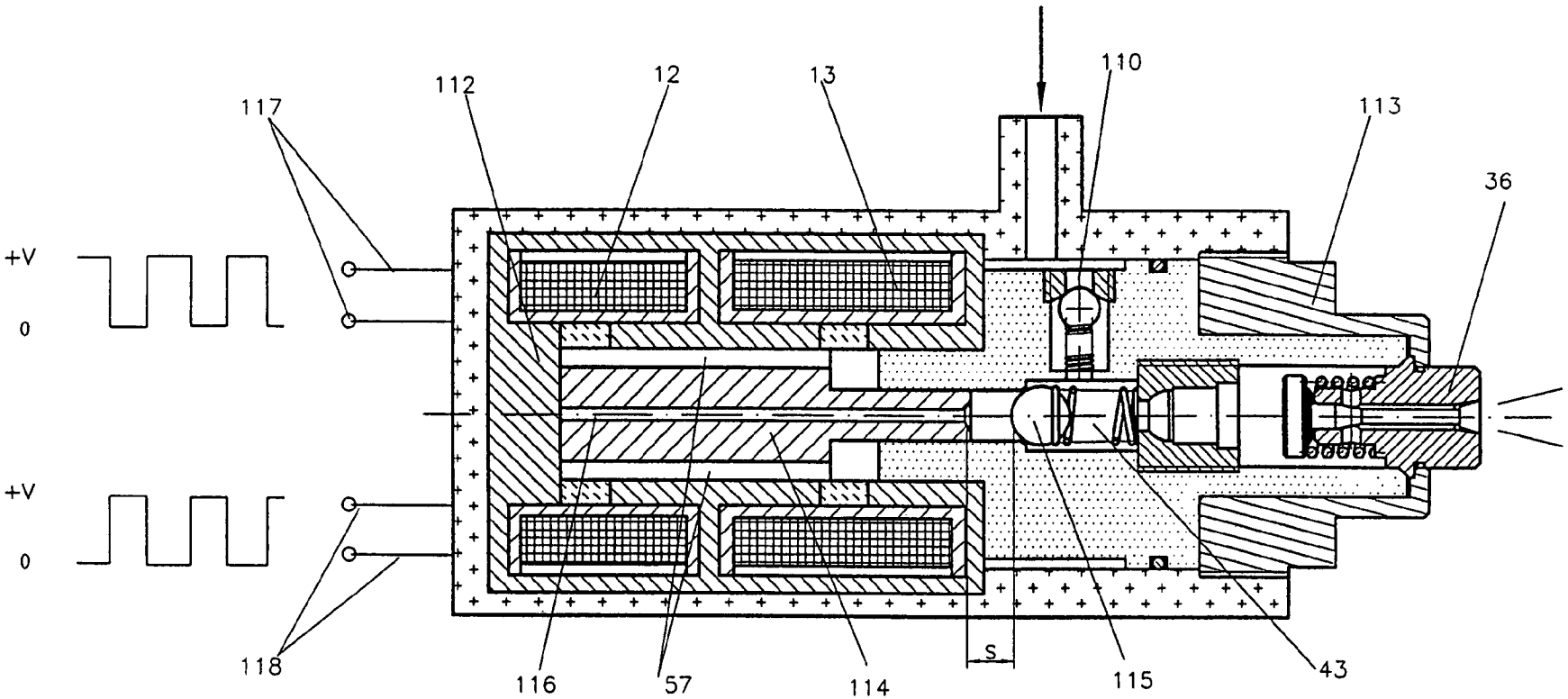
FIG. 1 is a longitudinal section view of electrically operated fuel injection apparatus according to an embodiment of the present invention.

In a first embodiment, at an initial time of each cycle, the follower 114 is situated in a rear-most position as shown in FIG. 1. The fuel is introduced from the fuel intake means 110 into the pressure chamber 43 of the actuating means 112. When pulse current begins flow in the working coil 13 of the actuating means, the electromagnetic force generated by the magnetic field generated from the current will accelerate, in the forward direction, the follower 114, which, when touching the ball valve body 115 by its leading end, will impact the fuel inside the compression pressure chamber 43 making its pressure up. When the fuel pressure becomes sufficiently high, the self-opening fuel atomizer nozzle 36 of the fuel injection means will open to inject the fuel. The injection ends when a reverse electromagnetic driving force generated from the pulse current in the return coil 12 acts on the follower 114 and makes it return, and then new fuel is introduced into the pressure chamber 43 and a fuel injection cycle is completed.

The inventive equipment may generate sufficiently high injection pressure within limited time with limited electromagnetic force, because before compressing the fuel, the follower 114 has a free accelerating travel without any load, and thus has accumulated adequate kinetic energy for impacting the fuel in the pressure chamber 43. That is, at the initial position, the leading end of the follower 114 does not touch the valve body 115, but has a gap S there between. When moving forward, the follower 114 does not compress the fuel in the pressure chamber 43 since the spaces in the front of and behind the follower are communicated with each other through the through-hole 116. Consequently, additionally due to the existence of the longitudinal through grooves 57, the movement of the follower almost suffers no resistance. After a predetermined course S, the valve body 15 closes the passage 116, and thus the fuel in the pressure chamber 43 begins to be compressed. Due to adequate kinetic energy accumulated in the follower 114 during the no load course, the fuel pressure in the pressure chamber 43 will rise to an extent enough to inject the fuel out of the fuel injection means 112 and atomize the fuel. In fact, after the course S, if the forward electromagnetic force continues to act on the follower 114, then the power for pressurizing the fuel in the pressure chamber 43 further includes the electromagnetic force besides the impact force of the follower 114. Apparently, the injection pressure and the injection quantity depend partially on the amplitude of the electromagnetic force and the length of the acting period of the electromagnetic force. When the pulse current in the working coil 13 ends or is about to end, the pulse current in the return coil begins to rise, and thus a reverse force begins to acts on the follower 114, which eventually begins to return to its initial position. During the return course, fresh fuel is introduce into the pressure chamber 43 via the means 110 and all come back to the initial state.

In a second embodiment, the components of the invention are further modified. The working coil 13 and the return coil 12 are respectively wound round non-metal frames 18, 14, and insulating materials 17, 15 are filled in the peripheral of the coils. The magnetic loop around the working coil 13 comprises electromagnetic elements 7, 6, 8, 10, 9, working magnetic gap 11 and the front half of the armature 56. The magnetic loop around the return coil 12 comprises electromagnetic elements 1, 2, 3, 6, 4, return magnetic gap 5 and the rear half of the armature 56. The working magnetic gap 11 or return magnetic gap 5 may comprises clearance or non-electromagnetic elements made of, such as, plastics, copper or stainless steel and so on. The section of either of the coils 12, 13 is substantially rectangular or trapezoid. Said two electromagnetic loops are received in a housing 19, which is provided with fuel inlet 20 and fuel return port 59. The housing 19 and the front-end element 32 are coupled with each other by screw connection 84, and thus all the components are restrained to respective positions.

In the second embodiment, the follower 114 is formed in two parts, that is, an armature 56 and an plunger 46.The general geometric form of the armature 56 is a revolution body, on which are machined longitudinal holes and/or grooves 57, circumferential groove(s) 63 and other holes 62 and cavities and so on. Wherein, the longitudinal grooves 57 are used as fuel passages and contribute to reduce the mass of the armature, which mass will affect the high speed characteristics and impact force. The fuel flowing through the grooves 57 washes and thus cools the armature 56 and nearby components. The grooves 57 also contribute to reduce the resistance to the motion of the armature 56. The circumferential groove 63 is provided in the central portion between the two end faces of the said armature in a form of material cutout, which is to adjust the mass of the armature, without affecting the linear movement thereof. As part of the fuel returning passage, the holes or grooves 62 ensure the returning fuel flow when the armature 56 is in the rear end position. A cylindrical cavity 53 is provided for housing a spacer 54 and a portion of the ball valve 52. One end of the spacer 54 is a planar surface 55 for contacting the armature; the other end is a conical surface, upon which the valve body 52 resides. In addition, a boss 83 is provided on the front end of the armature 56. The spacer 54 and the ball valve 52 are restrained in the cavity 53 through pressed deformation of the boss 83.

The armature 56 reciprocates in a space 50, which is substantially cylindrical. The side face of the cylindrical space 50 is formed by part of the cases forming said two magnetic loops. One end face of the cylindrical space is formed by the end element 60, and the boundary of the other end is comprised of the end faces respectively of the plunger 46, the plunger sleeve 82 and the cavity body 33. For preventing the armature from being adhered on the end face 58 when the armature moved to touch the end face, and thus preventing the high-speed characteristics from being deteriorated, an elastic element 109 for energy storage with very small axial deformation (for example, 0.05–0.3 mm) may be arranged between the end element 60 and the armature 56. The Glastic element may be curved sheet steel, or may be a spiral wire spring. One end of the reciprocating motion of the armature 56 is defined by said elastic element 109 for energy storage. To keep the armature in the initial position when the coils are not powered, the end element 60 may be made of hard magnetic material, or a spring 48 of minimal stiffness may be disposed in the armature chamber. The length of the armature is designed so that in the initial position, the end face 81 of the armature is positioned just within the length of the working magnetic gap 11. The other end of the motion of the armature 56 is defined depending on the electrical pulses of the working coil 13 and the return coil 12 and etc.

The plunger 46 and the armature 56 are arranged coaxially and the plunger 46 passes through the inner bore of the plunger sleeve 82. One end of the plunger 46 extends into the armature chamber 50 and the other end extends into the pressure chamber 43. On one end of the plunger 46, that is the end in the armature chamber 50, is provided a conical valve seat 47. On the other end of the plunger 46, that is the end in the pressure chamber 43, is provided a disc shoulder 68 and a length of spring guide 67 in cylindrical form. The diameter of the disc shoulder 68 is greater than the diameter of the inner bore of the plunger sleeve 82, so that when the disc shoulder 68 contacts the end face of the plunger sleeve 82, the further movement of the plunger 46 toward the armature chamber 46 is restrained. Along the central axes of the plunger 46, one or more passages 45 communicating the pressure chamber 43 and the armature chamber 50 are provided for discharging the bubbles in the pressure chamber and for returning fuel. The passages 45 will be closed if the valve body 52 contacts with the valve seat 47. The fit between the plunger 46 and the plunger sleeve 82 meets the requirement as in common plunger fuel pump. The plunger sleeve 82 may be a portion of the cavity body 33, or may be formed as a separate component to be engaged into the cavity body 33 in a manner of stationary fit.

The pressure chamber 43 is provided in the cavity body 33. One end boundary of the pressure chamber 43 is the end face 44 of the plunger sleeve and the other end boundary is the end face 69 of the fuel delivery valve 30. On the side wall of the pressure chamber 43 is disposed a fuel inlet hole 28, the other end of which is communicated with a one-way valve 27. In the pressure chamber 43, a spring 42 is used to return the plunger 46. One end of the spring 42 is pressed on the shoulder 68 of the plunger, the other on the end face 69 of the fuel delivery valve.

The fuel delivery valve 30 is arranged between the finishing end of the pressure chamber 43 and the beginning end of the high-pressure passage 41. The fuel delivery valve 30 comprises a valve body 29, a spring 31, a valve seat 85 and a back cover 71, wherein the valve body 29 is spherical and the valve seat 72 is an axisymmetric curved surface; or the valve body 29 is a planar sheet while the valve seat 72 is an O-ring. One end of the spring 31 presses the valve body 29 against the tight surface 72 of the valve seat, and the other end presses against the back cover 71. The stiffness of the spring 31 will influence the amplitude of the residual pressure in the high-pressure passage 41. A predetermined residual pressure is maintained in the high-pressure passage 41 for preventing bubbles from being generated due to the vaporization of the fuel therein.

The high-pressure passage 41 refers to the space, which the fuel can reach, from the outlet end face 70 of the fuel delivery valve 31 to the sealing area 35 of the injection nozzle. The high-pressure passage 41 is substantially a cylindrical space, the length of which depends on the distance between the fuel delivery valve 30 and the injection nozzle 36. If said distance is very large, then a high-pressure fuel pipe, as the high-pressure passage 41, may be provided between the fuel delivery valve 30 and the injection nozzle 36.

The injection nozzle 36 is a conical valve pretightened by spring and located in the downstream of the high-pressure passage 41. The injection nozzle 36 comprises a nozzle body 86, a conical valve stem 40, a valve cap 73, a pretightening spring and etc. The cone 74 of one end of the conical valve stem 40 constitutes a valve body; the conical surface of the discharge port of the fuel passage 37 in the injection nozzle 36 constitutes a valve seat. By the pre-tightened force of the spring 39, the valve body is pressed against the valve seat 75 so that the injection nozzle is closed. The fuel enters into the passage 37 via an inlet 38. When the force pushing the valve stem 40, which is generated by the fuel pressure, becomes greater than the pre-tightened force of the spring, the injection nozzle opens and the fuel is injected out.

The fuel inlet 20 is communicated directly with a circumferential groove 22 arranged around the pressure chamber 22. A portion of the fuel in the circumferential groove 22 flows via a passage 49 into the armature chamber 50 and the rest of the fuel flows via a one-way valve 23 into the pressure chamber 43. On the cavity body are arranged two O-rings 78 and 23, which substantially excludes the possibility of leakage of the fuel via other paths. The one-way valve 23 comprises a valve body 25, a valve seat 76 and a spring 26.

The fuel return port 59 arranged in the housing 19 is substantially along the axes of the armature 56 and located on the end of the armature opposite to the plunger 46. The position of the fuel return port is defined like this mainly for forming a longitudinal pressure gradient in the armature chamber 50. It is well known that in a liquid having a pressure gradient, the bubbles will move in a negative direction of the gradient. Thus, the bubbles in the armature chamber 50, especially near the valve seat 47, will be discharged out along the liquid flowing direction. The bubbles near the valve seat 47 mainly come from the pressure chamber 43. When the armature 56 is in its initial position, due to the separating of the valve body 52 from the valve seat 47, the pressure chamber 43 will be communicated with the armature chamber 50, and thus the bubbles in the pressure chamber 43 will arrive at the valve seat 47 via the passage 45.

Figure 4:
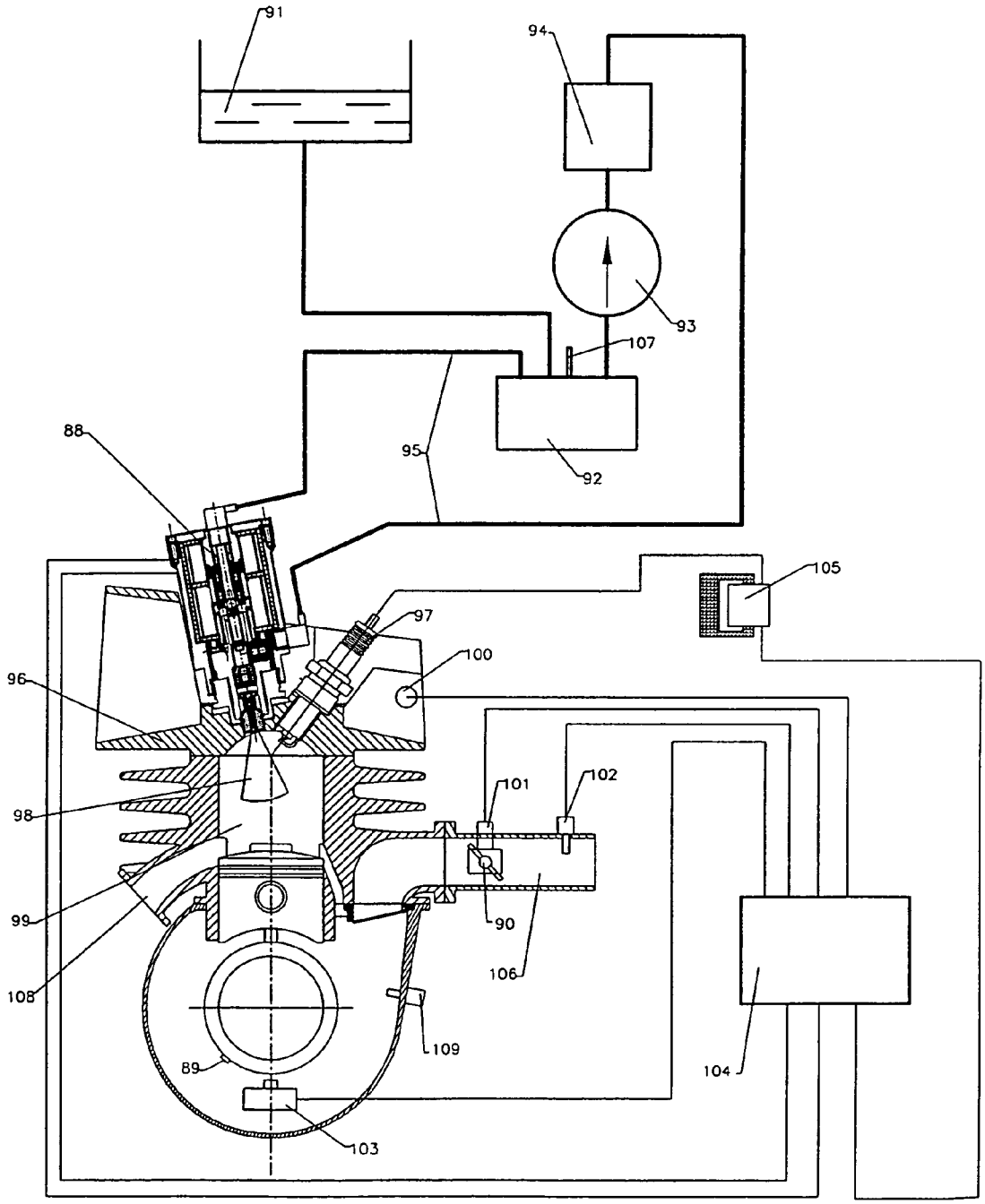
FIG. 4 is a schematic view of a two-stroke engine adopting an electrically operated fuel injection apparatus of the present invention.
Figure 2:
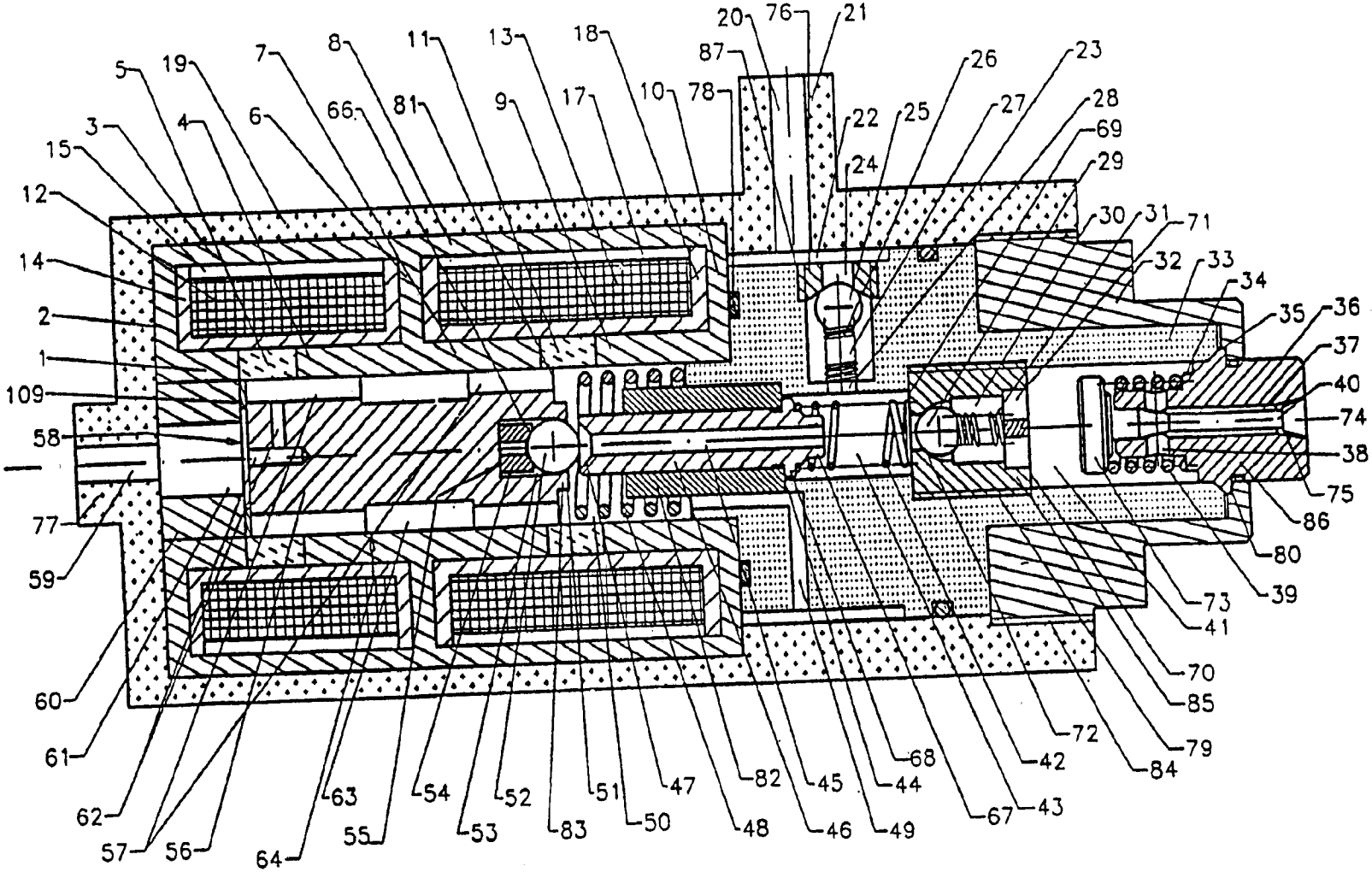

The inventive fuel injection equipment is applicable to internal combustion engine, such as four-stroke spark ignition engine with intake port fuel injection system or with in-cylinder fuel direct injection system, and especially applicable to two-stroke spark ignition engine with in-cylinder fuel direct injection system. FIG. 4 shows a two-stroke spark ignition engine with in-cylinder fuel direct injection system incorporating the inventive apparatus.

The inventive fuel injection equipment 88 is mounted on the cylinder head 96. It functions to pressurize the fuel from a low pressure fuel pump 93 and inject the pressurized fuel into the combustion chamber 99 of the cylinder. The injection is controlled by an electronic controlling unit 104 so as to occur after the exhaust port has been closed and before the spark plug sparks. The fuel injection quantity and the injection timing is determined mainly according to signals coming from a throttle position sensor 101 and/or a crankcase pressure sensor 109, an inlet air temperature sensor 102 and a sensor 103 for sensing the crank angle and revolution speed of the crankshaft. A portion of the fuel supplied from the low pressure fuel pump 93 is injected by the fuel injection means 88 into the cylinder and combusts therein, while most of the fuel cycles in a loop comprised of a low pressure fuel pipe 95, a cooler 92, a fuel pump 93, and a fuel filter 94 and so on. The principle function of the loop is to take away the heat in the fuel injection means 88. A fuel quantity corresponding to that consumed by the combustion in the engine is replenished from a fuel tank 91 into the cooler 92. When the engine operates, above system substantially excludes the possibility of part of the fuel being discharged directly without combustion into the atmosphere via the exhaust port 108. This is because, on one hand, the scavenging is completed totally by fresh air instead of combustible gas mixture; on the other hand, stratified mixture combustion and/or multi-cycles of scavenging are adopted so that misfire at low-load operating condition is prevented at a maximum extent. Compared to two-stroke engine with a carburetor fuel system, the inventive system will make the engine's fuel consumption rate remarkably lowered, and compared to four-stroke engine, it will have a higher performance per liter and a higher average effective pressure.

A two-stroke engine with in-cylinder fuel injection system requires the operating frequency of the fuel injection apparatus as two times high as that of a four-stroke engine, because in a two-stroke engine, there is one combustion per 360° of the crankshaft revolution; while in a four-stroke engine, there is one combustion per 720° of the crankshaft revolution. For example, in a two-stroke engine has a maximal revolution of 9000 rpm, the operating frequency of the injection means shall be higher than 150 Hz. The inventive electrically operated fuel injection apparatus may overcome the drawbacks of the known fuel injection equipment having only single magnetic loop, which equipment is hard to operate reliably in high speed. The inventive equipment is especially applicable to the four-stroke or two-stroke engines adopted in motorcycle and having usually very high speed of revolution.

The above-described embodiments are merely examples for explaining the invention, not for defining the invention. Any modification or variation made with the concept of the invention and being obvious to a person skilled in the art will fall into the scope of protection of the appended claims.

What is claimed is:

1. An electrically operated fuel injection apparatus comprising: a fuel intake means (110), a fuel pumping means (112) and a fuel injecting means (113), wherein the fuel introduced via the fuel intake means (110) is pumped by the fuel pumping means (112) and injected out from the fuel injecting means (113), wherein the fuel pumping means (112) includes a working coil (13), a return coil (12) and a follower (114) driven by the electromagnetic fields induced from said coils, and said follower (114) is driven forwardly by the electromagnetic loop formed by said working coil (13) to inject the fuel out from said fuel injecting means (113), and is returned by the electromagnetic loop formed by the return coil (12), said follower comprising an armature (56) and a plunger (46) with a central fuel channel (45) running through it, wherein said working coil (13) and the return coil (12) are arranged coaxially, and wherein said armature (56) and the plunger (46) are two separated components that are spaced apart from each other depending on actuation of the return coil (12) and working coil (13).

2. The electrically operated fuel injection apparatus of claim 1, characterized in that, said plunger (46) is cylindrical and with a shoulder (68) on the leading end.

3. The electrically operated fuel injection apparatus of claim 2, characterized in that, between said plunger (46) and armature (56) is disposed a valve for closing the fuel channel (45) under the control of the armature (56).

4. The electrically operated fuel injection apparatus of claim 3, characterized in that, the valve body (52) of said valve is mounted on the leading end of the armature (56), and the valve seat (47) is disposed in the rear end of the plunger (46).

5. The electrically operated fuel injection apparatus of claim 3, characterized in that, said valve body (52) is spherical and the valve seat (47) has a conical surface, the valve body (52) is embedded in the armature (56) and a spacer is disposed between the ball valve (52) and the armature (56).

6. The electrically operated fuel injection apparatus of claim 1, characterized in that, the shape of said armature (56) is substantially cylindrical with axial through-hole or through groove (57) machined therein.

7. The electrically operated fuel injection apparatus of claim 6, characterized in that, said armature (56) moves in an armature chamber (50) but the front-end face (81) of the armature is constantly located within and/or near a magnetic gap (11), the rear end face (58) of the armature is constantly located within and/or near a magnetic gap (5).

8. The electrically operated fuel injection apparatus of claim 7, characterized in that, a boss (83) is provided on the armature (56)'s front-end face (81).

9. The electrically operated fuel injection apparatus of claim 8, characterized in that, the elements constituting the wall of the armature chamber (50) includes electromagnetic elements (4, 9) sliding fitted with the armature (56), and non-electromagnetic elements (5, 11) clearance fitted with the armature (56).

10. The electrically operated fuel injection apparatus of claim 1, characterized in that, the fuel intake means includes a circumferential groove (22) provided on the cavity body (33), a fuel intake port (20) disposed on the housing and a one-way valve (27).

11. The electrically operated fuel injection apparatus of claim 10, characterized in that, an outlet (28) on said one-way valve (27) is communicated with a pressure chamber (43) and an inlet (24) thereof is communicated with the circumferential groove(22), and a channel (49) communicating the armature chamber (50) with the circumferential groove(22) is provided on the cavity body (33).

12. The electrically operated fuel injection apparatus of claim 7, characterized in that, between the armature chamber (50) and the fuel returning outlet (59) is disposed a rear end element (60), in which is formed a through-hole (61), and channels or grooves (62) are provided in the armature (56) to communicate the through-hole (61) with the through groove (57).

13. The electrically operated fuel injection apparatus of claim 1, characterized in that, said fuel injecting means comprises a fuel delivery valve (30), a high-pressure fuel passage (41) and an atomizer nozzle (36).

14. The electrically operated fuel injection apparatus of claim 13, characterized in that, the fuel delivery valve (30) comprises a valve body (29), a valve seat (72) and a spring (31), wherein the valve body (29) is a spherical ball and the valve seat (72) is an axisymmetric curved surface.

15. The electrically operated fuel injection apparatus of claim 13, characterized in that, the high-pressure fuel passage (41) is a hole, for mounting the atomizer nozzle (76), in the cavity body (33).

16. The electrically operated fuel injection apparatus of claim 13, characterized in that, the high-pressure fuel passage (41) is an inner bore of a high-pressure fuel pipe communicating the fuel delivery valve (30) with the atomizer nozzle (36).

17. The electrically operated fuel injection apparatus of claim 14, characterized in that, the atomizer nozzle (36) comprises a nozzle body (86), a needle stem (40) and a spring (39), wherein the cone portion (74) in the front end portion of the needle stem constitutes a valve body, the conical surface (75) of the nozzle body constitutes a valve seat, and the nozzle body is provided with fuel inlets (38) and a passage (37), a valve cap (73) is formed integral with the valve stem (40), so that the axial gap between the nozzle body and said valve cap constitutes the maximum lift range of the needle valve.

18. The electrically operated fuel injection apparatus of claim 15, characterized in that, the atomizer nozzle (36) comprises a nozzle body (86), a needle stem (40) and a spring (39), wherein the cone portion (74) in the front end portion of the needle stem constitutes a valve body, the conical surface (75) of the nozzle body constitutes a valve seat, and the nozzle body is provided with fuel inlets (38) and a passage (37), a valve cap (73) is formed integral with the valve stem (40), so that the axial gap between the nozzle body and said valve cap constitutes the maximum lift range of the needle valve.

* * * * *

UNITED STATES PATENT AND TRADEMARK OFFICE

CERTIFICATE OF CORRECTION

Figure 2:
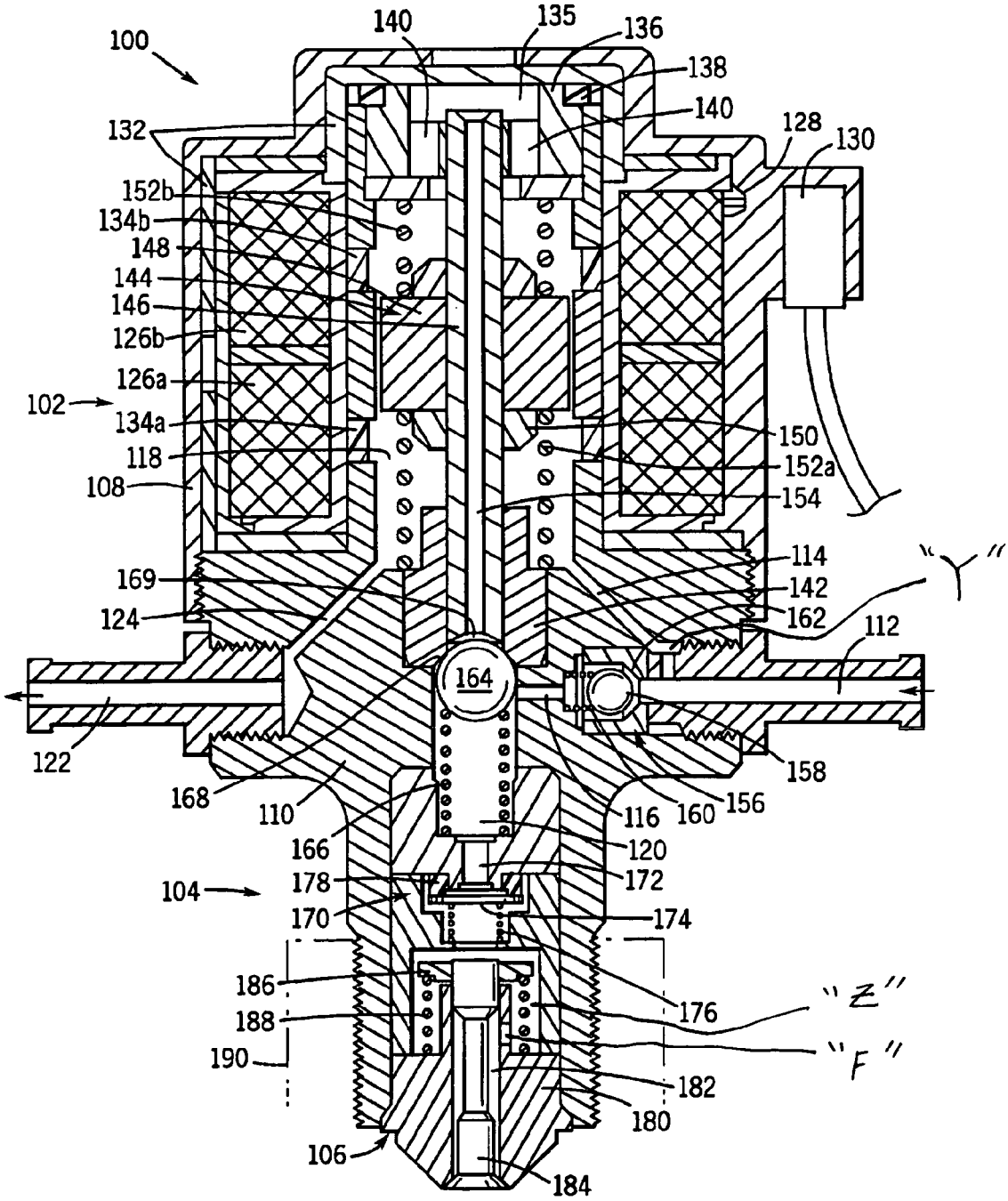
FIG. 2 is a longitudinal section view of electrically operated fuel injection apparatus according to a modified embodiment of the present invention.
Figure 3:
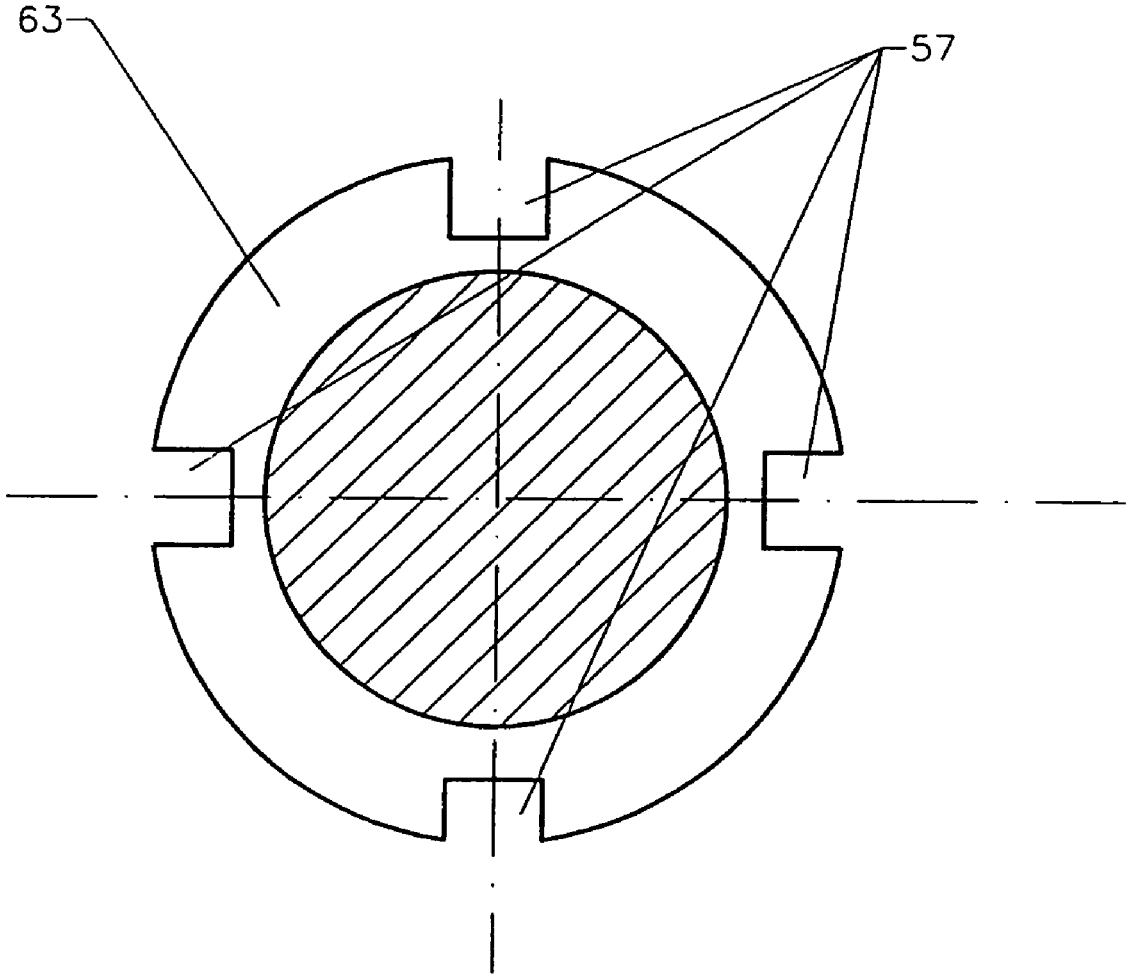
FIG. 3 is a cross section view of an armature according to the present invention.

PATENT NO. : 6,964,263 B2
APPLICATION NO. : 10/468099
DATED : November 15, 2005
INVENTOR(S) : Xi, Daguang It is certified that error appears in the above-identified patent and that said Letters Patent is hereby corrected as shown below:

Drawing sheet of Figure 2 should be deleted to be replaced with the attached page.

Signed and Sealed this

Twentieth Day of June, 2006

JON W. DUDAS
*Director of the United States Patent and Trademark Office*